US007607498B2

(12) United States Patent
Roussy

(10) Patent No.: US 7,607,498 B2
(45) Date of Patent: Oct. 27, 2009

(54) ASSEMBLY AND METHOD FOR DISCHARGING FLUID INTO A DRILL STRING OF A ROTARY-VIBRATORY DRILL

(76) Inventor: Raymond J. Roussy, 12491 - 57A Avenue, Surrey, British Columbia (CA) V3X 2S6

( * ) Notice: Subject to any disclaimer, the term of this patent is extended or adjusted under 35 U.S.C. 154(b) by 137 days.

(21) Appl. No.: 11/478,851

(22) Filed: Jul. 3, 2006

(65) Prior Publication Data

US 2008/0000692 A1 Jan. 3, 2008

(51) Int. Cl.
*E21B 10/36* (2006.01)

(52) U.S. Cl. ..... 175/415; 166/177.6; 175/113

(58) Field of Classification Search ..... 175/56, 175/113, 415, 189, 55; 166/249, 90.1, 177.6, 166/177.1; 464/18; 173/49, 143, 55; 433/119, 433/120

See application file for complete search history.

(56) References Cited

U.S. PATENT DOCUMENTS

| | | | | | |
|---|---|---|---|---|---|
| 3,507,341 | A | | 4/1970 | Basgan | |
| 3,734,212 | A | * | 5/1973 | Perlewitz | 175/171 |
| 3,907,252 | A | * | 9/1975 | Gaarder | 254/8 B |
| 4,058,163 | A | | 11/1977 | Yandell | |
| 4,253,531 | A | | 3/1981 | Boros | |
| 4,260,380 | A | * | 4/1981 | Nash | 433/119 |
| 4,553,443 | A | * | 11/1985 | Rossfelder et al. | 74/22 R |
| 4,723,350 | A | * | 2/1988 | Kobayashi et al. | 29/417 |
| 5,027,908 | A | * | 7/1991 | Roussy | 173/49 |
| 5,409,070 | A | * | 4/1995 | Roussy | 173/49 |
| 5,417,290 | A | * | 5/1995 | Barrow | 175/56 |
| 5,540,295 | A | * | 7/1996 | Serrette | 175/56 |
| 5,549,170 | A | * | 8/1996 | Barrow | 175/55 |
| 5,562,169 | A | | 10/1996 | Barrow | |
| 6,814,166 | B1 | * | 11/2004 | LaFreniere et al. | 175/57 |
| 2002/0066558 | A1 | * | 6/2002 | Mullins | 166/90.1 |
| 2002/0117334 | A1 | * | 8/2002 | Smith et al. | 175/20 |
| 2003/0116314 | A1 | * | 6/2003 | Dallas | 166/249 |
| 2004/0035574 | A1 | * | 2/2004 | Pippert | 166/90.1 |
| 2005/0155758 | A1 | * | 7/2005 | Webb et al. | 166/177.6 |

OTHER PUBLICATIONS

American Seal and Packing "Braided valve packing, mechanical packing, compression packing . . . " last modified Jan. 13, 2003, http://www.usseal.com/packing/valve.*

American Seal and Packing "Thermabraid" no date http://www.usseal.com/tbraid.html.*

* cited by examiner

*Primary Examiner*—David J Bagnell
*Assistant Examiner*—Cathleen R Hutchins
(74) *Attorney, Agent, or Firm*—Berenato, White & Stavish

(57) ABSTRACT

According to one aspect of the invention there is provided a rotary-vibratory drilling apparatus. The drilling assembly is comprised of a vibratory apparatus, a rotary drive apparatus, a drill string, a first conduit and a second conduit. The first conduit communicates with the second conduit and the second conduit communicates with the drill string. The drilling assembly may further include a fluid reservoir communicating with the first conduit. Fluid may be discharged from the fluid reservoir into the first conduit, fluid may be discharged from the first conduit into the second conduit, and fluid may be discharged from the second conduit into the drill string. The first conduit may be threadedly connected to the second conduit.

20 Claims, 8 Drawing Sheets

ASSEMBLY AND METHOD FOR DISCHARGING FLUID INTO A DRILL STRING OF A ROTARY-VIBRATORY DRILL

BACKGROUND OF THE INVENTION

This invention relates to an apparatus and method for discharging fluid into a drill string and, in particular, for discharging fluid into the drill string of a rotary-vibratory drill also known as a sonic drill.

It is known to discharge fluid into the drill string of a rotary-vibratory drill as the drill string is being rotated or vibrated into the ground. The fluid helps flush ground cuttings from the bottom of the well bore to the surface, and the fluid maintains a hydrostatic pressure at the bottom of the well bore which restricts ground materials from entering the well bore.

Rotary-vibratory drills impart both rotary and vibratory forces to the drill string. As such, conventional rotary-vibratory drills require a heavy swivel assembly mounted underneath the drill head in order to effectively discharge fluid into the drill string. There is therefore a need for a more efficient apparatus for discharging fluid into the drill string of a rotary-vibratory drill.

SUMMARY OF THE INVENTION

According to one aspect of the invention there is provided a rotary-vibratory drilling apparatus. The drilling apparatus is comprised of a vibratory apparatus, a rotary drive apparatus, a drill string, a first conduit, and a second conduit. The first conduit communicates with the second conduit and the second conduit communicates with the drill string.

The drilling apparatus may further include a fluid reservoir communicating with the drill string. Fluid may be discharged from the fluid reservoir into the first conduit, fluid may be discharged from the first conduit into the second conduit, and fluid may be discharged from the second conduit into the drill string. The first conduit may be threadedly connected to the second conduit.

According to another aspect of the invention, there is provided a method of discharging fluid through the drill head and into the drill string of a rotary-vibratory drill. The method comprises, operatively connecting a fluid reservoir to communicate with a first conduit in a manner such that fluid may be discharged from the fluid reservoir into the first conduit. The first conduit extending into the drill head. Operatively connecting the first conduit to communicate with a second conduit in a manner such that fluid may be discharged from the first conduit into the second conduit. The second conduit extending through the drill bead from a location adjacent the first conduit to a location adjacent the drill head. Operatively connecting the second conduit to communicate with the drill string in a manner such that fluid may be discharged from the second conduit into the drill string. Sealing the first conduit against the drill head. Operatively connecting the second conduit to a rotary drive apparatus of the rotary-vibratory drill in a manner such that the second conduit may be actuated by the rotary drive apparatus. Discharging fluid from the fluid reservoir.

The present invention offers the advantage of eliminating the need for a heavy swivel assembly mounted underneath the drill head to effectively discharge fluid into the drill string, and the present invention offers the advantage allowing for a variety of seal assemblies and seal assemblies smaller in diameter than would otherwise be necessary.

BRIEF DESCRIPTION OF THE DRAWINGS

Referring to the drawings.

DETAILED DESCRIPTION OF THE PREFERRED EMBODIMENT

Figure 1:
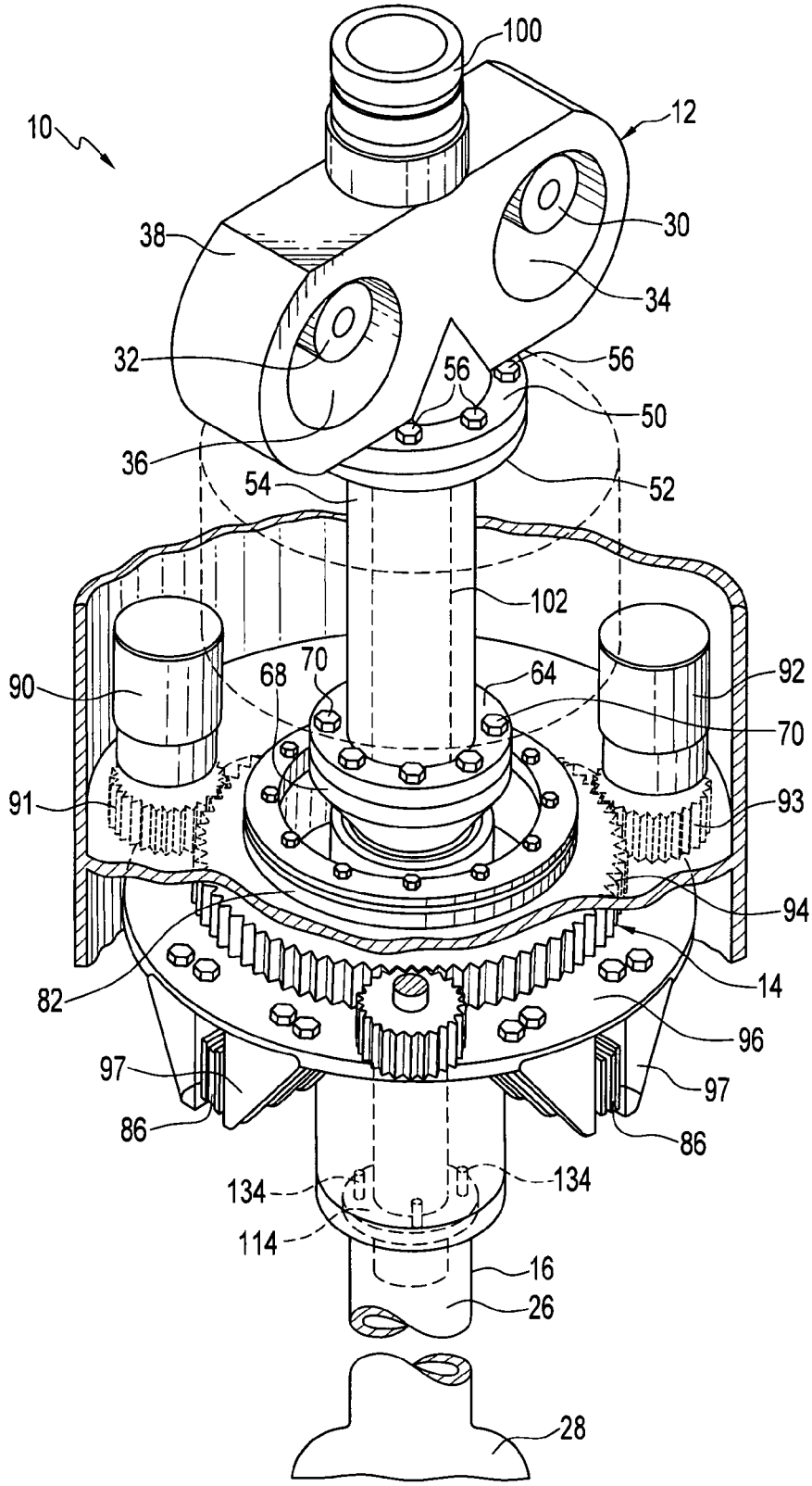
FIG. 1 is a fragmentary, partly broken away, isometric view showing a rotary-vibratory drill having an assembly for discharging fluid into the drill string, according to an embodiment of the invention.
Figure 2:
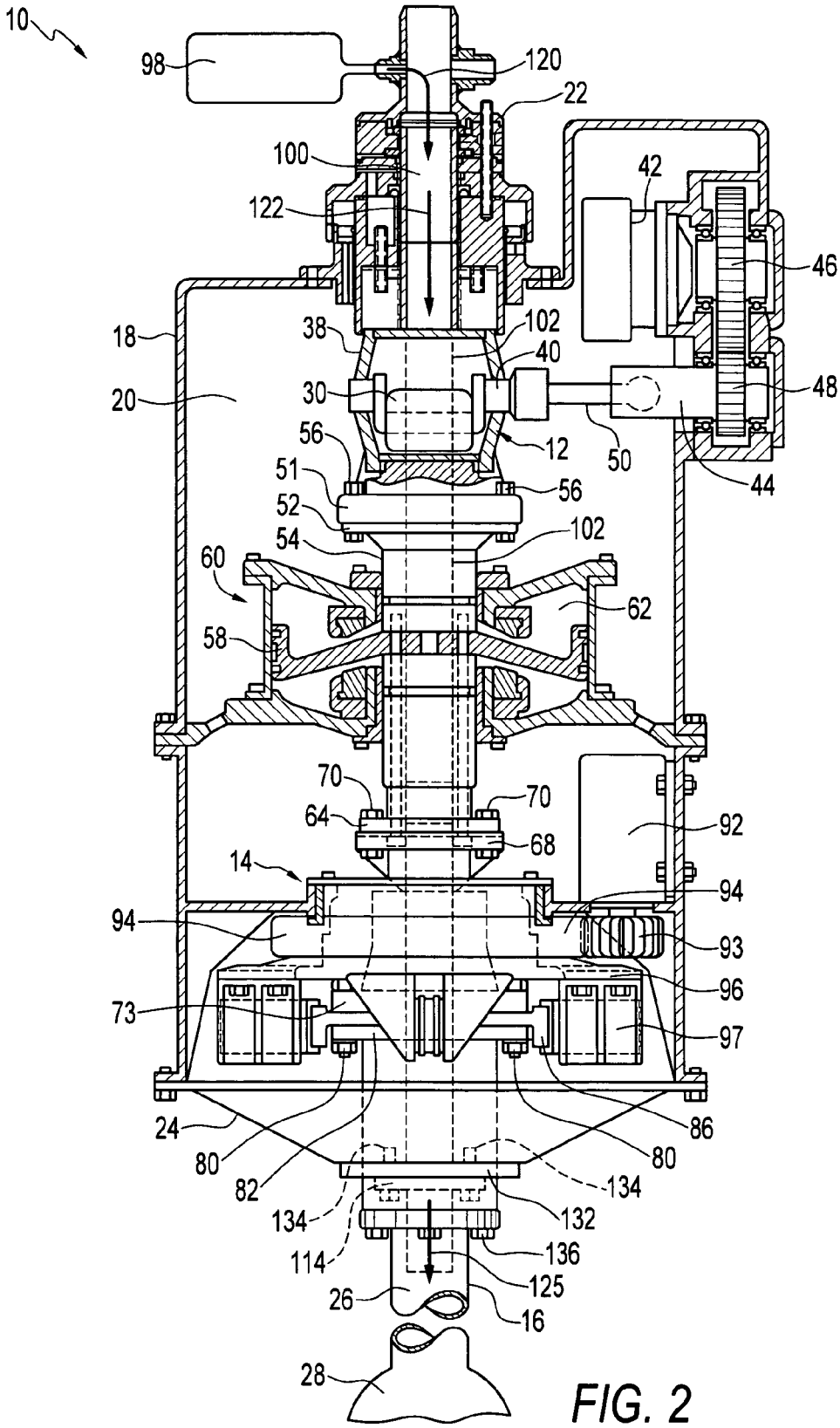
FIG. 2 is an elevational, partly broken away, side view showing a rotary-vibratory drill having an assembly for discharging fluid into the drill string, according to an embodiment of the invention.

Referring to the drawings and first to FIGS. 1 and 2, there is shown a rotary-vibratory drill 10 having an assembly for discharging fluid into the drill string according to a preferred embodiment of the invention. The drill 10 is comprised generally of a vibratory apparatus 12, a rotary drive apparatus 14, and a drill string 16. As best shown in FIG. 2, the vibratory apparatus 12 and rotary drive apparatus 14 are contained within a housing 18 of a drill head 20 which has top 22 and a bottom 24. The drill string 16, which is shown in fragment, is comprised of a drill pipe 26 and drill bit 28. The drill string 26 extends from the bottom 24 of the drill head 20.

As best shown in FIG. 1, the vibratory apparatus 20 is comprised a pair of counter rotating rollers 30 and 32 within cylindrical cavities 34 and 36 of a vibrator housing 38. Referring back to FIG. 2, the counter rotating rollers rotate on crankshafts, such as crankshaft 40 shown for roller 30. Crankshaft 40 is rotated by a hydraulic motor 42 coupled to a first rotatable shaft 44 by gears 46 and 48. The first rotatable shaft 44 is connected to the crank 40 by a second rotatable shaft 50. The counter rotating rollers 30 and 32 impart vibratory forces to the vibrator housing 38 which in turn provides the vibratory output to the drill bit 28.

Figure 3:
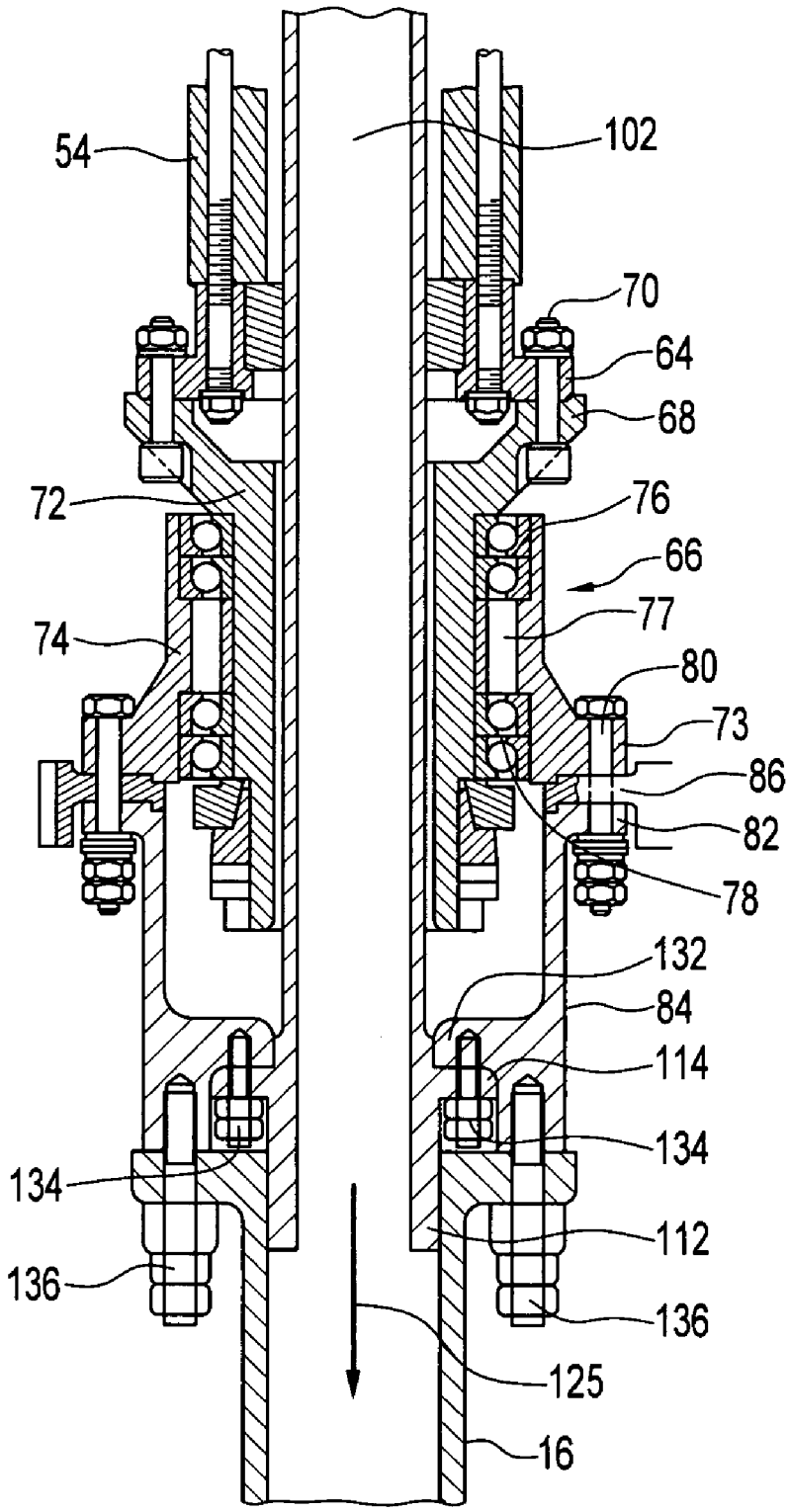
FIG. 3 is an enlarged sectional view of a rotary-vibratory drill having an assembly for discharging fluid into the drill string showing the second conduit of the assembly communicating with the drill string.

There is a flange 51 located at the bottom of the vibratory apparatus 12 which is mounted on a corresponding flange 52 of a first hollow shaft 54 by a plurality of nuts and bolts 56. As best shown in FIG. 2, the first hollow shaft 54 has an integral piston 58 that forms part of a dashpot assembly 60. The piston 58 is received reciprocatingly within a cylindrical housing 62 that guides the vertical vibrations imparted by the vibratory apparatus 12. The bottom of the first hollow shaft 54 is connected by a flange 64 to a bearing assembly 66, which is shown in FIG. 3. The flange 64 is mounted on a corresponding flange 68 of the bearing assembly 66 by a plurality of nuts and bolts 70.

In FIG. 3, the bearing assembly 66 is a bearing assembly similar to that disclosed in my earlier U.S. Pat. No. 5,027,908 which is incorporated herein by reference. The bearing assembly 66 is therefore only described briefly here. The bearing assembly 66 is comprised of an inner shaft like member 72, of hollow construction, within an annular outer member 74. The outer member 74 is rotatably supported on the inner member 72 by two pairs of angular contact roller bearings 76 and 78, which are separated by a sleeve-like spacer 77. Bearing pair 76 transmit a downward vertical force from the inner member 72 to the outer member 74 along an axis parallel to an axis of rotation of the drill string 16. Bearing pair 78 transmit an upward vertical force from the inner member 72 to the outer member 74 along an axis parallel to an axis of rotation of the drill string 16. Both bearing pairs 76 and 78 further transmit radial forces imparted by the rotary drive apparatus 14 to the drill string 16.

The rotary drive apparatus 14 imparts rotary motion to the drill string 16 in a manner similar to that disclosed in my earlier U.S. Pat. No. 5,409,070 which is incorporated herein by reference. The impartation of rotary motion to the drill string 16 by the rotary drive apparatus 14 is therefore only described briefly here. The outer member 74 of the bearing assembly 66 has a bottom flange 73 connected by a plurality of nuts and bolts 80 to a top flange 82 of a second hollow shaft 84 with a first annular member 86 being received therebetween. The second hollow shaft 84 may be connected to a drill string, and the first annular member 86 is operatively connected the rotary drive apparatus 14.

The rotary drive apparatus 14 is comprised of a plurality of hydraulic motors. Hydraulic motors 90 and 92 are shown in FIG. 1. Each motor is connected to a pinion, pinions 91 and 93 being shown for motors 90 and 92. The pinions engage a ring gear 94 which is mounted on a second annular member 96. The second annular member 96 has a support members 97 that engages the first annular member 86, thereby imparting rotary motion to the bearing assembly 66. The bearing assembly 66, in turn, provides rotary output to the drill bit 28.

According to the present invention and as best shown in FIG. 2, there is a first conduit 100 that communicates with a fluid reservoir 98 near the top 22 of the drill head 20 as indicated generally by reference arrow 120. The reservoir is normally connected to a high pressure pump and fluid tank (not shown). The first conduit 100 further communicates with a second conduit 102 near the top 22 of the drill head 20 as indicated generally by reference arrow 122. The second conduit 102 extends through the drill head 20, from near the top 22 of the drill head 20 to near the bottom 24 of the drill head 20. The second conduit 102 communicates with the drill string 16 at a location indicated by arrow 125, near the bottom 24 of the drill head 20. Fluid may therefore be discharged from the fluid reservoir 98 into the first conduit 100, as indicated by arrow 120. From the first conduit 100 into the second conduit 102 as indicated by arrow 122. From the second conduit 102 into the drill string 16, as indicated by arrow 125.

Figure 4:
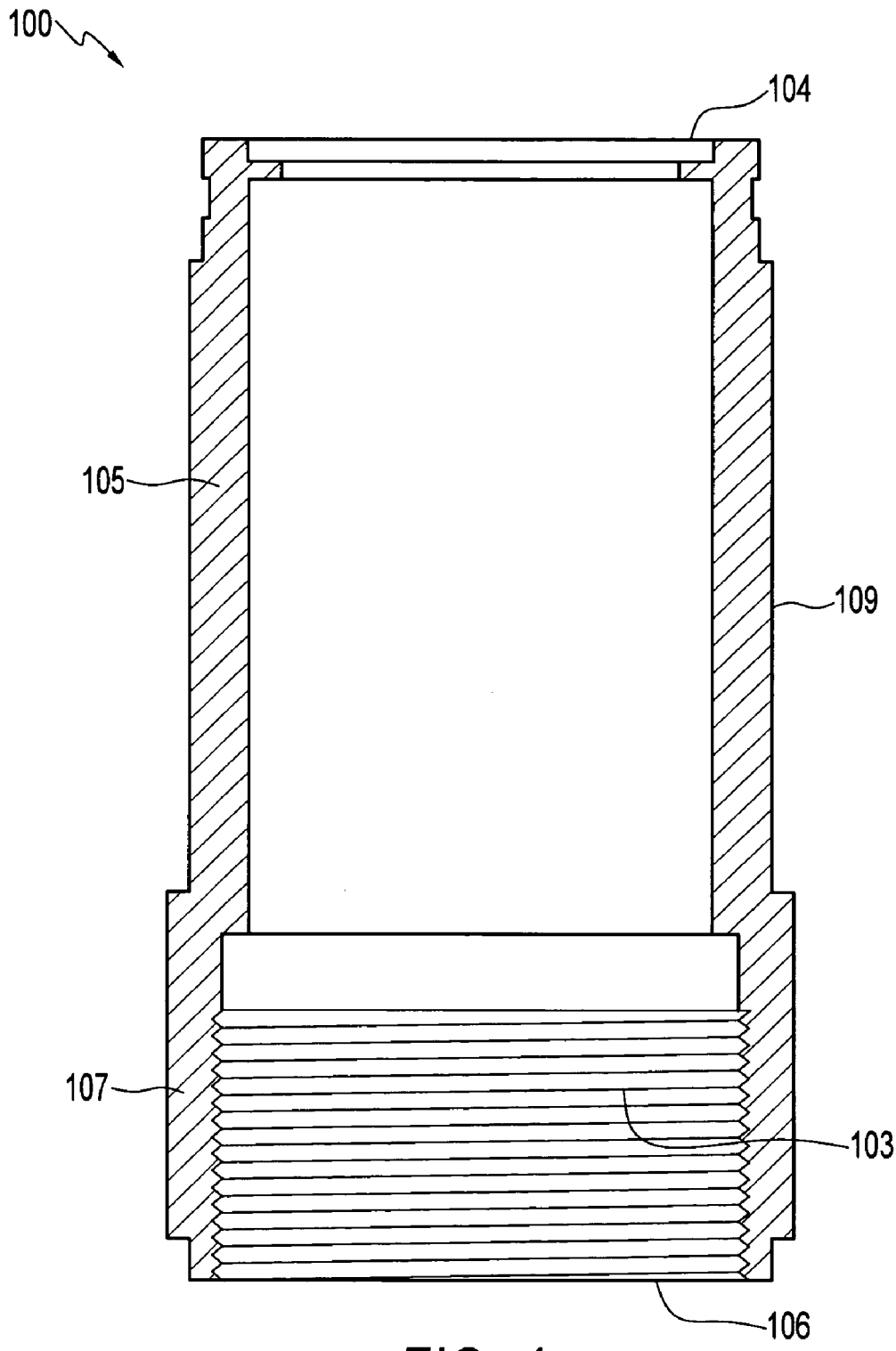
FIG. 4 is an isometric view showing the first conduit of the assembly, according to an embodiment of the invention.

The first conduit 100 is best shown in FIG. 4, according to an embodiment of the invention. The first conduit 100 is a pipe having a first end 104 and a second end 106, and a first portion 105 and a second portion 107. The first portion 105 of the first conduit 100 is located adjacent the first end 104 of the first conduit 100, and the second portion 107 of the first conduit 100 is located adjacent the second end 106 of the first conduit 100. There is female threading 103 adjacent to the second end 106 of the first conduit 100.

Figure 5:
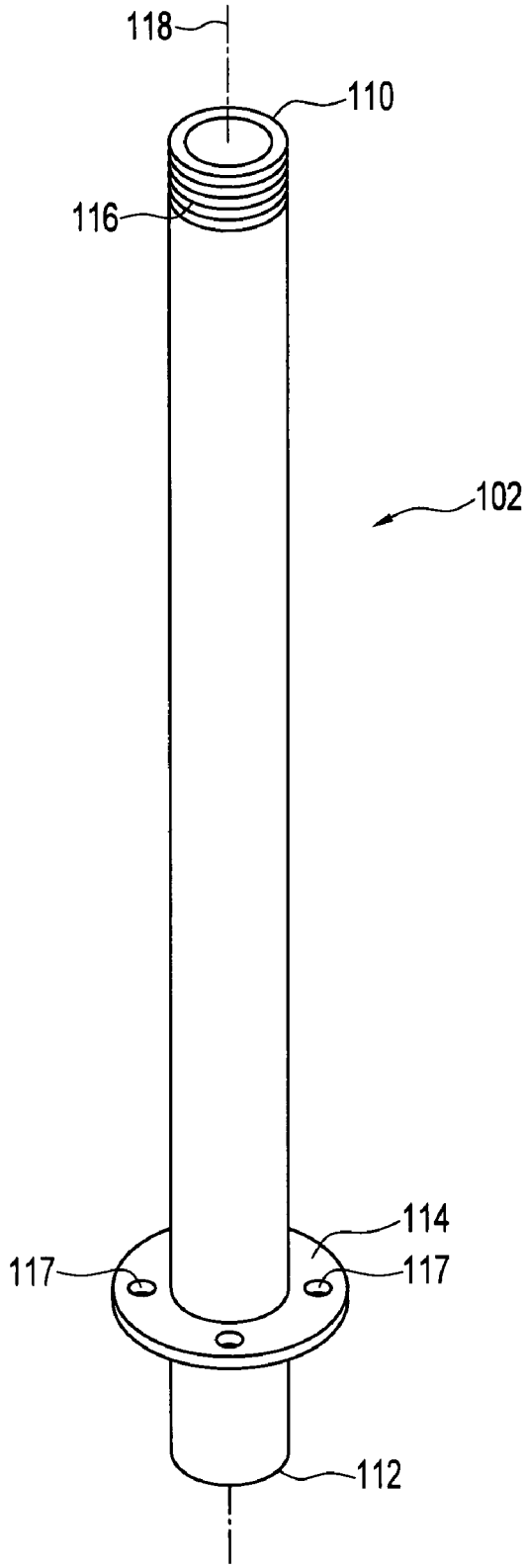
FIG. 5 is an isometric view showing the second conduit of the assembly, according to an embodiment of the invention.
Figure 6:
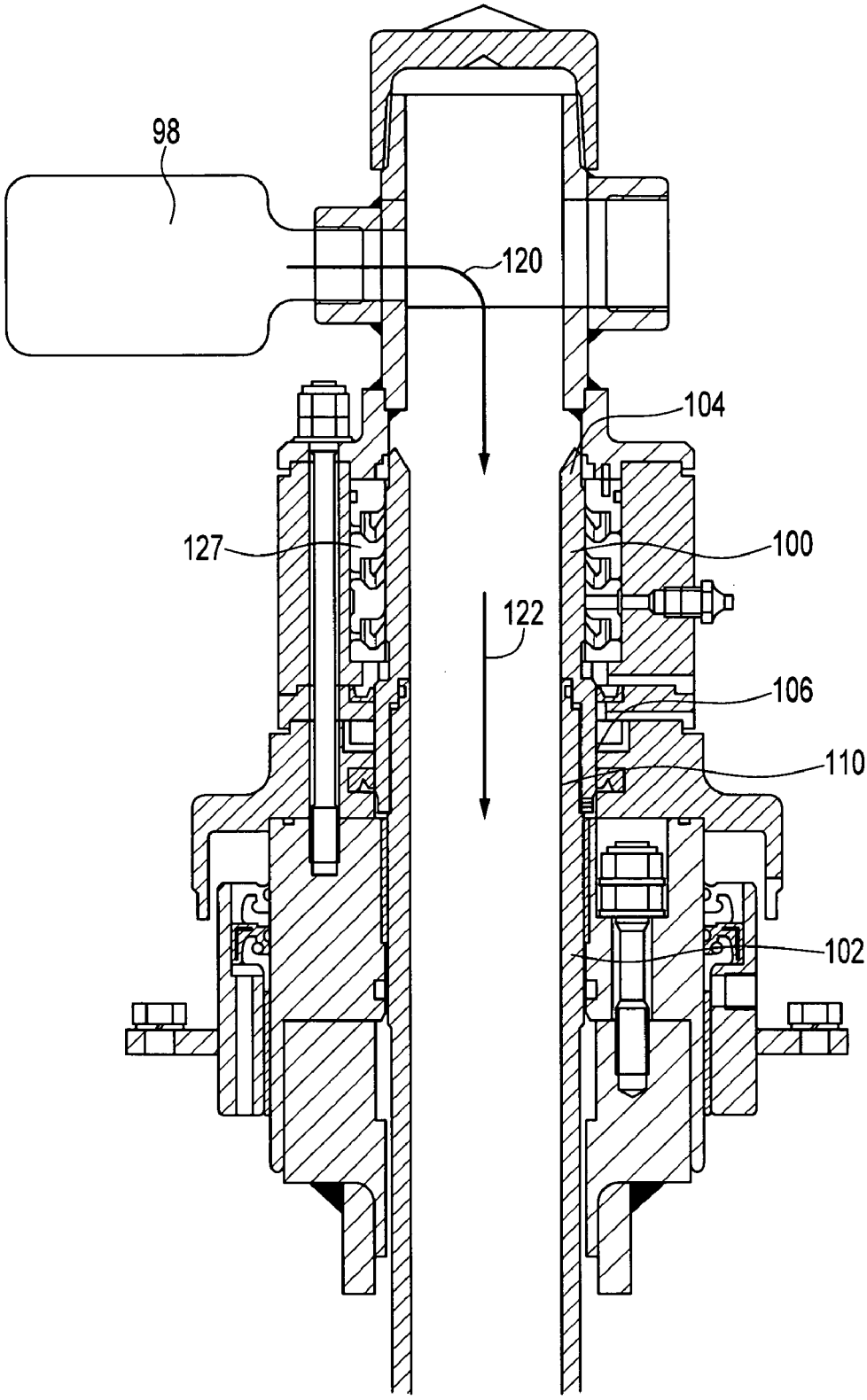
FIG. 6 is an enlarged sectional view of a rotary-vibratory drill having an assembly for discharging fluid into the drill string showing a high pressure seal assembly.

The second conduit 102 is best shown in FIGS. 5 and 6. The second conduit 102 is a pipe having a first end 110, a second end 112, and a flange 114. The second conduit 102 is longer than the first conduit 100. There is male threading 116 adjacent the first end 110 and the flange 114 is located near the second end 112. There are a plurality of apertures 117 extending through the flange 114 along an axis generally parallel to a longitudinal axis 118 of the second conduit 102.

As shown best in FIG. 6, the second end 106 of the first conduit 100 may threadedly receive the second conduit 102, thereby allowing the first conduit 100 to communicate with the second conduit 102 as indicated generally by arrow 122.

As best shown in FIG. 3, the flange 114 of the second conduit 102 is connected to an internal flange 132 of the second hollow shaft 84 by a plurality of nuts and bolts 134. The second hollow shaft 84 is in turn connected to the drill string 16 by plurality of nuts and bolts 136, thereby allowing the second conduit 102 to communicate with the drill string 16 as indicated generally by arrow 125.

Referring back to FIG. 2, the second conduit 102, extends from adjacent the first conduit 100 near the top 22 of the drill head 20 to adjacent the drill string 16 near the bottom 24 of the drill head 20. Within the drill head 20, the second conduit extends through the vibratory apparatus 12, through the first hollow shaft 54, through the inner member 72 of the bearing assembly 66 and through the second hollow shaft 84, thereby allowing the second conduit 102 to be rotated by the bearing assembly 66.

Figure 7:
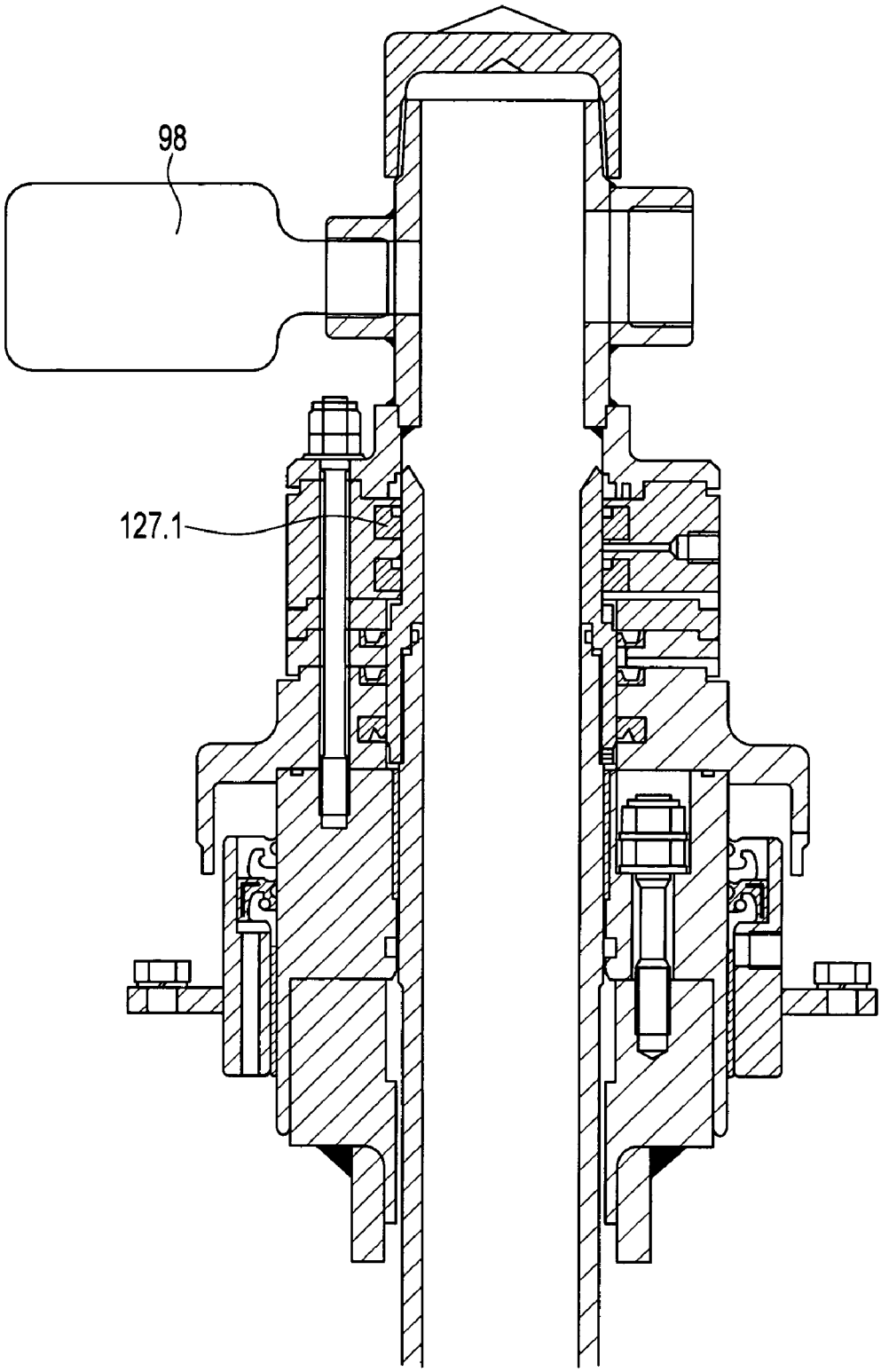
FIG. 7 is an enlarged sectional view of a rotary-vibratory drill having an assembly for discharging fluid into the drill string showing a reinforced polytetrafluoroethylene seal assembly.

The present invention allows for various different seal assemblies such as seal assembly 127 and seal assembly 127.1 as shown by FIGS. 6 and 7 respectively. In environmental applications where petroleum products are not permitted to come into contact with drilling fluid, a reinforced polytetrafluoroethylene seal assembly 127.1 may be used as shown in FIG. 7. Alternately, in mud drilling applications where abrasives are present a lubricated seal assembly 127 may be used as shown in FIG. 6. This seal is satisfactory for pressures of 3500 psi or greater.

When the drill 10 is operational, the drill string 16 is rotated and vibrated into the ground as a fluid is simultaneously discharged into the drill string 16. The fluid helps flush ground cuttings from the bottom of the well bore to the surface and the fluid maintains a hydrostatic pressure at the bottom of the well bore which restricts ground materials from entering the well bore. The present invention provides an efficient apparatus for discharging fluid into the drill string 16, as best shown in FIG. 2. Fluid may be discharged from the fluid reservoir 98 into the first conduit 100 near the top 22 of the drill head 20, as indicated by arrow 120. The fluid passes through the first conduit 100 and is discharged into the second conduit 102, as indicated by arrow 122. The fluid passes through the second conduit 102 and is discharged into the drill sting 16, as indicated by arrow 125. The first conduit 100 and second conduit 102 may be rotated synchronously with the drill string 16. In this embodiment of the invention the seal is assembly is vibrating.

Figure 8:
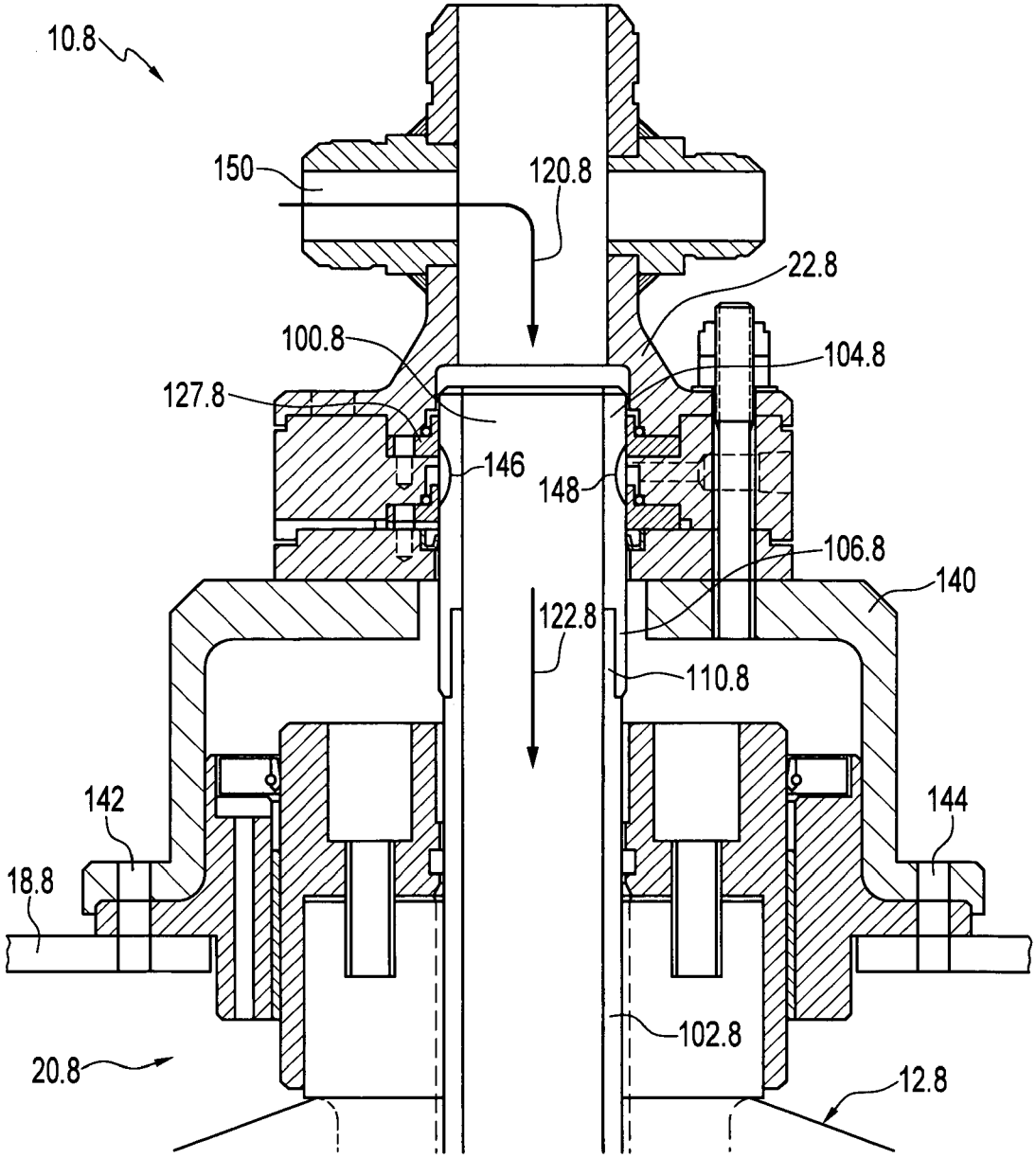
FIG. 8 is an enlarged sectional view of a different embodiment of a rotary-vibratory drill having an assembly for discharging fluid into the drill string showing a stationary seal assembly and stationary inlet conduit.

A further embodiment is shown in FIG. 8, where this shows a variation generally similar to the previous embodiment and like parts have like numbers with the additional designation "0.8". In FIG. 8, the sealing assembly 127.8 is designed such that it is stationary. Elaborating, mounting member 140 is rigidly connected by bolts 142 and 144, respectively, to outer housing 18.8 of the drill head, and thus mounting member 140 is stationary. The fluid reservoir (not shown), inlet conduit 150, top 22.8 of the drill head and seal assembly 127.8 are all functionally connected to the mounting member 140, and thus are also all stationary, meaning they do not vibrate nor rotate with the drill. It follows that the mounting member 140 is an example of a means for substantially eliminating transfer of vibration from the vibratory apparatus to said seal assembly 127.8 and said inlet conduit 150. The inlet conduit 150 and the first conduit 100.8 are shown extending perpendicularly relative to one another, with the first conduit 100.8 having an upper end that terminates below the inlet conduit 150, as shown for example in FIG. 8, so as to not obstruct the inlet conduit 150. The inlet conduit can comprise an inlet hose. In the embodiment shown in FIG. 8, there is a first conduit 100.8 and a second conduit 102.8, but in an alternative embodiment, there may be a single conduit. Because the seal assembly 127.8 is stationary, the seal areas 146 and 148, respectively, will be subject to linear wear in addition to rotary wear. This embodiment provides the advantage of increasing the duration time of inlet conduit 150, for example an inlet hose, before it fails by breaking, as the stationary seal assembly 127.8 acts to eliminate the vibration of the inlet conduit 150.

The present invention has many industrial applications including but not limited to the installation of geothermal loops as disclosed in my pending U.S. patent application Ser. No. 11/067,225 which is incorporated herein by reference. The invention may also be used in pressure grouting applications using abrasive and comentatious fluids.

It will be further understood by someone skilled in the art that many of the details provided above are by way of example only and are not intended to limit the scope of the invention which is to be determined with reference to the following claims.

What is claimed is:

1. A sonic drilling apparatus comprising:

a drill head comprising a drill head housing, a top having an inlet conduit constructed and arranged to permit communication with a fluid reservoir, and a bottom;

a drill string extending from the bottom of the drill head;

a vibratory apparatus disposed in the drill head housing and operatively connected to the drill string, the vibratory apparatus comprising a vibratory apparatus housing and first and second counter-rotating rollers rotatable in respective cavities of the vibratory apparatus housing to generate sonic range vibrations which are imparted to the drill string;

a first conduit extending into the top of the drill head housing and communicating with the inlet conduit for receiving fluid from the fluid reservoir and transmitting the fluid to a second conduit, the first conduit being in direct fluid communication with the fluid as the fluid passes therethrough;

the second conduit extending between the first conduit and the drill string, the second conduit being substantially disposed in the drill head housing and in communication with both the first conduit and the drill string for receiving fluid from the first conduit and transmitting the fluid to the drill string;

a rotary drive apparatus disposed in the drill head and operatively connected to the drill string for rotating the drill string, the first conduit, and the second conduit; and a seal assembly sealing the first conduit with respect to the drill head.

2. The sonic drilling apparatus as claimed in claim 1, further comprising a bearing assembly for isolating rotational movement generated by the rotary drive apparatus from the drill head housing.

3. The sonic drilling apparatus as claimed in claim 1, wherein the vibratory apparatus further comprises:

a motor; and first and second crankshafts operatively connected to the first and second counter-rotating rollers.

4. The sonic drilling apparatus as claimed in claim 1, wherein the first conduit and second conduit are threadedly engaged.

5. The sonic drilling apparatus as claimed in claim 1, wherein the first conduit and the second conduit are integral with respect to one another so as to constitute a unitary conduit.

6. The sonic drilling apparatus as claimed in claim 1, wherein the rotary drive apparatus comprises:

a motor;

a pinion drivable by the motor;

a ring gear operatively engaging the pinion to cause rotation of the driven pinion;

a first annular member rotatable with the ring gear;

a hollow shaft operatively connecting the first annular member to the drill string.

7. The sonic drilling apparatus as claimed in claim 1, wherein the seal assembly comprises a reinforced polytetrafluoroethylene seal assembly.

8. The sonic drilling apparatus as claimed in claim 1, wherein the seal assembly is a lubricated low pressure seal assembly capable of sealing up to 450 psi.

9. The sonic drilling apparatus as claimed in claim 1, wherein the seal assembly is a lubricated high pressure seal assembly capable of sealing at least 3,500 psi.

10. The sonic drilling apparatus as claimed in claim 1, further comprising a mounting member operatively connecting the drill head housing to the top of the drill head to maintain the top of the drill head, the inlet conduit of the top of the drill head, and the seal assembly stationary.

11. A sonic drilling apparatus comprising:

a drill head comprising a drill head housing, a top having an inlet conduit constructed and arranged to permit communication with a fluid reservoir, and a bottom;

a drill string extending from the bottom of the drill head;

a vibratory apparatus disposed in the drill head housing and operatively connected to the drill string;

a first conduit extending into the top of the drill head housing and communicating with the inlet conduit for receiving fluid from the fluid reservoir and transmitting the fluid to a second conduit, the first conduit being in direct fluid communication with the fluid as the fluid passes therethrough and having an upper end terminating below the inlet conduit so as to avoid any obstruction of the inlet conduit when the first conduit is rotating;

the second conduit extending between the first conduit and the drill string, the second conduit being substantially disposed in the drill head housing and in communication with both the first conduit and the drill string for receiving fluid from the first conduit and transmitting the fluid to the drill string;

a rotary drive apparatus disposed in the drill head and operatively connected to the drill string for rotating the drill string, the first conduit, and the second conduit; and a seal assembly sealing the first conduit with respect to the drill head.

12. The sonic drilling apparatus as claimed in claim 11, further comprising a bearing assembly for isolating rotational movement generated by the rotary drive apparatus from the drill head housing.

13. The sonic drilling apparatus as claimed in claim 11, wherein the first conduit and second conduit are threadedly engaged.

14. The sonic drilling apparatus as claimed in claim 11, wherein the first conduit and the second conduit are integral with respect to one another so as to constitute a unitary conduit.

15. The sonic drilling apparatus as claimed in claim 11, wherein the rotary drive apparatus comprises:

a motor;

a pinion drivable by the motor;

a ring gear operatively engaging the pinion to cause rotation of the driven pinion;

a first annular member rotatable with the ring gear;

a hollow shaft operatively connecting the first annular member to the drill string.

16. The sonic drilling apparatus as claimed in claim 11, wherein the seal assembly comprises a reinforced polytetrafluoroethylene seal assembly.

17. The sonic drilling apparatus as claimed in claim 11, further comprising a mounting member operatively connecting the drill head housing to the top of the drill head to maintain the top of the drill head, the inlet conduit of the top of the drill head, and the seal assembly stationary.

18. The sonic drilling apparatus as claimed in claim 11, wherein the first conduit and the inlet conduit extend perpendicularly to one another.

19. A sonic drilling apparatus comprising:

a drill head comprising a drill head housing, a top having an inlet conduit constructed and arranged to permit communication with a fluid reservoir, and a bottom;

a drill string extending from the bottom of the drill head;

a vibratory apparatus disposed in the drill head housing and operatively connected to the drill string, the vibratory apparatus comprising a vibratory apparatus housing and first and second counter-rotating rollers rotatable in respective cavities of the vibratory apparatus housing to generate sonic range vibrations which are imparted to the drill string;

a first conduit extending into the top of the drill head housing and communicating with the inlet conduit for receiving fluid from the fluid reservoir and transmitting the fluid to a second conduit, the first conduit being in direct fluid communication with the fluid as the fluid passes therethrough and having an upper end terminating below the inlet conduit so as to avoid any obstruction of the inlet conduit when the first conduit is rotating;

the second conduit extending between the first conduit and the drill string, the second conduit being substantially disposed in the drill head housing and in communication with both the first conduit and the drill string for receiving fluid from the first conduit and transmitting the fluid to the drill string;

a rotary drive apparatus disposed in the drill head and operatively connected to the drill string for rotating the drill string, the first conduit, and the second conduit synchronously; and a seal assembly sealing the first conduit with respect to the drill head.

20. The sonic drilling apparatus as claimed in claim 19, wherein the first conduit and the inlet conduit extend perpendicularly to one another.

* * * * *